US009909391B2

(12) United States Patent
Girola

(10) Patent No.: US 9,909,391 B2
(45) Date of Patent: Mar. 6, 2018

(54) DEVICE FOR ENSURING CONTINUOUS CIRCULATION IN WELL DRILLING

(71) Applicant: HAD ENGINEERING S.R.L., Saronno (IT)

(72) Inventor: Giorgio Girola, Cislago (IT)

(73) Assignee: HAD ENGINEERING S.R.L., Saronno (VA) (IT)

( * ) Notice: Subject to any disclaimer, the term of this patent is extended or adjusted under 35 U.S.C. 154(b) by 0 days.

(21) Appl. No.: 14/898,202

(22) PCT Filed: Jun. 16, 2014

(86) PCT No.: PCT/IB2014/062274
§ 371 (c)(1),
(2) Date: Dec. 14, 2015

(87) PCT Pub. No.: WO2014/203155
PCT Pub. Date: Dec. 24, 2014

(65) Prior Publication Data

US 2016/0138368 A1 May 19, 2016

(30) Foreign Application Priority Data

Jun. 17, 2013 (IT) ..... MI2013A0997

(51) Int. Cl.
*E21B 34/14* (2006.01)
*E21B 21/10* (2006.01)
(Continued)

(52) U.S. Cl.
CPC ..... *E21B 34/14* (2013.01); *E21B 21/106* (2013.01); *E21B 23/02* (2013.01); *E21B 34/066* (2013.01); *E21B 2034/005* (2013.01)

(58) Field of Classification Search
CPC ..... E21B 2034/005
See application file for complete search history.

(56) References Cited

U.S. PATENT DOCUMENTS 2,158,356 A 5/1939 Dyer
3,298,385 A * 1/1967 Jackson ..... E21B 21/106 137/112

(Continued)

FOREIGN PATENT DOCUMENTS

CN 102226382 A 10/2011
CN 202401994 U 8/2012
WO 2011/047163 A2 4/2011

OTHER PUBLICATIONS

Italian Search Report Corresponding to MI20130997 dated Feb. 3, 2014.

(Continued)

*Primary Examiner* — Giovanna C. Wright
*Assistant Examiner* — Brandon M Duck
(74) *Attorney, Agent, or Firm* — Daivs & Bujold PLLC; Michael J. Bujold

(57) ABSTRACT

A device for ensuring continuous circulation in well drilling comprises a tubular body having an axial channel therein, with a lateral opening closed by a removable plug. A flapper valve is placed in the tubular conduit, whose shut-off member is movable between a transverse position, in which it closes the axial channel, and a longitudinal position, in which it closes in a pressure-tight manner the lateral opening. Advantageously, the device comprises magnetic mechanism to operate on the shut-off member in the longitudinal position and retain it in the longitudinal position with a preset load, and as the latter is exceeded the shut-off member may be moved to the transverse position.

19 Claims, 8 Drawing Sheets

(51) Int. Cl.

| | |
|---|---|
| ***E21B 23/02*** | (2006.01) |
| ***E21B 34/06*** | (2006.01) |
| *E21B 34/00* | (2006.01) |

(56) References Cited

U.S. PATENT DOCUMENTS

| | | | | |
|---|---|---|---|---|
| 4,434,863 | A * | 3/1984 | Garrett | E21B 4/003 175/297 |
| 5,598,894 | A * | 2/1997 | Burleson | E21B 43/11852 166/297 |
| 7,845,433 | B2 | 12/2010 | Calderoni et al. | |
| 2009/0071654 | A1 | 3/2009 | O'Malley et al. | |
| 2009/0242817 | A1 | 10/2009 | Strazhgorodskiy | |
| 2011/0155379 | A1 | 6/2011 | Bailey et al. | |
| 2012/0032099 | A1 | 2/2012 | Vick, Jr. | |
| 2012/0298371 | A1 * | 11/2012 | Xu | E21B 34/10 166/332.8 |

OTHER PUBLICATIONS

International Search Report Corresponding to PCT/IB2014/062274 dated Aug. 25, 2014.

Chinese Office Action Corresponding to 201480034124.X dated Feb. 21, 2017.

* cited by examiner

DEVICE FOR ENSURING CONTINUOUS CIRCULATION IN WELL DRILLING

The present invention relates to a device as defined in the preamble of claim 1, for ensuring continuous circulation in well drilling, particularly during insertion or removal of a drill string in wells for hydrocarbon exploration and production.

For simplicity, the present disclosure will be made without limitation with particular reference to the step of insertion of a new drill string, the same considerations being also applicable to the step of removal of drill strings, when the drilling bit must be removed from the well, e.g. for replacement.

When drilling a hydrocarbon well, the process of insertion of a drill string is required for increasing the well drilling depth.

During insertion of a new string, continuous circulation of drilling mud must be ensured throughout the process until a complete pipe is obtained and the whole hydraulic circuit is restored. Indeed, pressure drops or variations in mud circulation have been found to cause considerable structural stresses in the well being drilled, which involve collapse in uncased structures of the well being drilled.

In order to ensure such continuous circulation of drilling mud throughout the drilling process, and hence also during the steps of insertion of new drill strings or removal of existing strings, devices have been long provided, for ensuring steady circulation of drilling mud even during insertion or removal of a drill string.

For example, U.S. Pat. No. 3,298,385 discloses a coupling device which is designed to ensure the above mentioned continuous circulation of drilling mud. Particularly, this device has an axial conduit through which the axial flow of drilling mud has to be ensured, and a lateral conduit communicating with the axial conduit through which a lateral flow of drilling mud may be fed. Valve means are inserted in the axial conduit, upstream from the lateral conduit, and have a shut-off member that can move between two distinct limit-stop positions, in which it safely closes the lateral conduit or the axial conduit. Under normal conditions, the self-weight of the movable shut-off member moves it close to the seat for the shut-off member, located at the lateral conduit.

Concerning the device of U.S. Pat. No. 3,298,385, it shall be noted that, while it is able to ensure continuous circulation of drilling mud even during addition of a new drill string (the new string being namely tightened into the nut screw provided at the upper end of the axial conduit of the device), it is affected by a number of technical drawbacks, that have limited its actual employment.

Particularly, once the device is fitted into the drill equipment between strings, the position of the movable shut-off member in the axial conduit is not well-defined.

Also, it shall be noted that any vibration propagating upwards from the drilling bit along the strings might cause the shut-off member to hammer against the shut-off member located at the lateral conduit, thereby causing wear/failure of the shut-off member itself. Very often, this hammering effect is also caused by the turbulent flow of the drilling mud introduced into the axial conduit.

Therefore, there arises the need of surely checking the position of the shut-off member in the axial conduit.

U.S. Pat. No. 7,845,433 provides a different dual-closure arrangement, i.e. having two distinct shut-off members (e.g. of the so-called flapper type): a first shut-off member designed for closing the axial conduit to temporarily stop the circulation of drilling mud from above the axial conduit, and another designed for closing the lateral conduit to allow the axial conduit section placed downstream from the first shut-off member to be fed with drilling mud flowing through the lateral conduit.

The device of U.S. Pat. No. 7,845,433 uses springs associated with the shut-off member to move the shut-off member itself to the rest position, in an attempt to obviate the problems noted above with reference to U.S. Pat. No. 3,298,385. In this respect, it shall be only noted that the technical solution of positioning the shut-off member in the tubular body of the device by the provision of springs is rather problematic, not only due to the acidity of the drilling mud, which is aggressive for the spring metal, but also because the flow of the drilling mud impinging upon the springs causes high wear levels on the springs and hinders operation thereof.

Furthermore, the provision of two distinct shut-off members is twice as problematic, and causes undesired operating conditions in the device, with the exact position of the shut-off members and the actual opened or closed state of the axial or lateral channel being not easily checked or determined, which will cause hazards for the operators at the well head, especially during removal of strings from the drill fittings. Indeed, during removal of a string, two devices are under pressure outside the well, one at eye level, i.e. at the same height as the drilling floor or working floor, and the other at the top of the string to be removed from the drill fittings.

In this respect it shall only be noted that drilling mud pressures are of the order or 300 atmospheres or more on average, and hence before disconnecting a part of the device the designated shut-off member shall be surely determined to perform its opening or closing task as required by the particular working step.

The present invention is based on the problem of conceiving a device for ensuring continuous circulation in well drilling, particularly during insertion or removal of a drill string into and out of wells for hydrocarbon exploration and production, that has such structural and functional characteristics as to fulfill the above need, while obviating the above mentioned prior art drawbacks.

This problem is solved by a device for ensuring continuous circulation in well drilling as defined in claim 1.

Further features and advantages of the device of the present invention for ensuring continuous circulation in well drilling will be apparent from the following description of a preferred exemplary embodiment thereof, which is given by way of illustration and without limitation with reference to the accompanying figures, in which.

Figure 1:
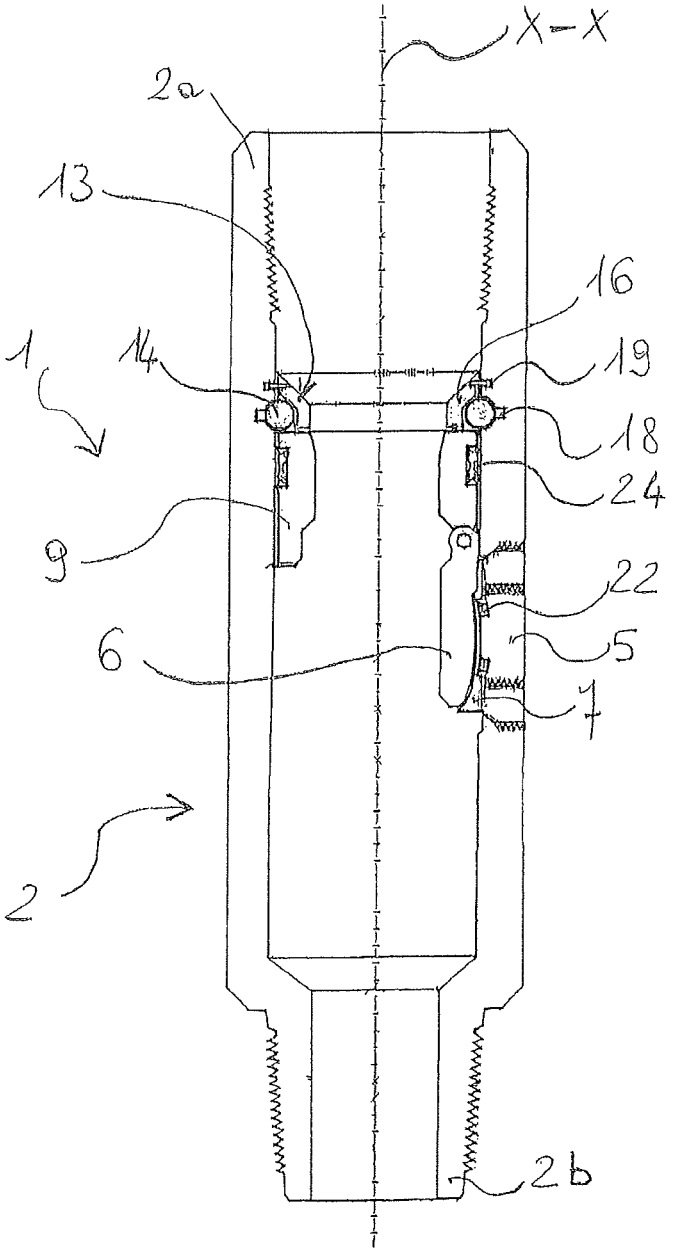
FIG. 1 shows a simplified longitudinal sectional view of the device of the invention, with the lateral conduit closed by the shut-off member in a longitudinal position.
Figure 2:
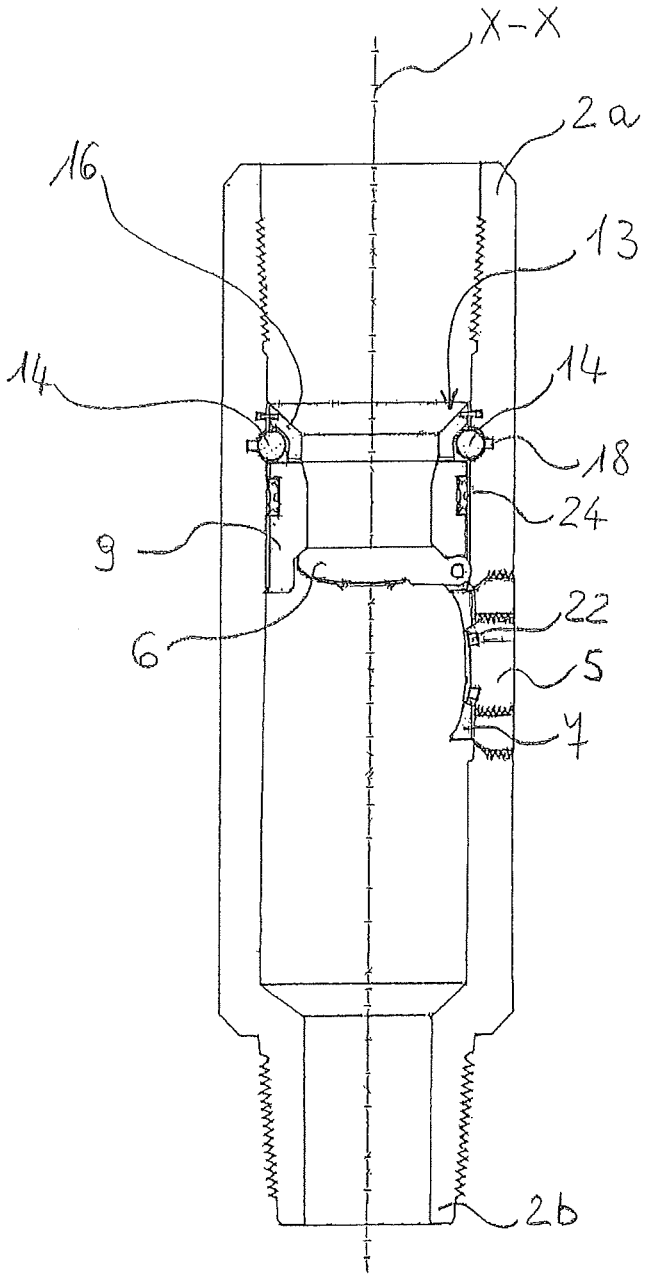
FIG. 2 shows a longitudinal sectional view of the device of FIG. 1, with the axial conduit closed by the shut-off member in a transverse position.
Figure 3:
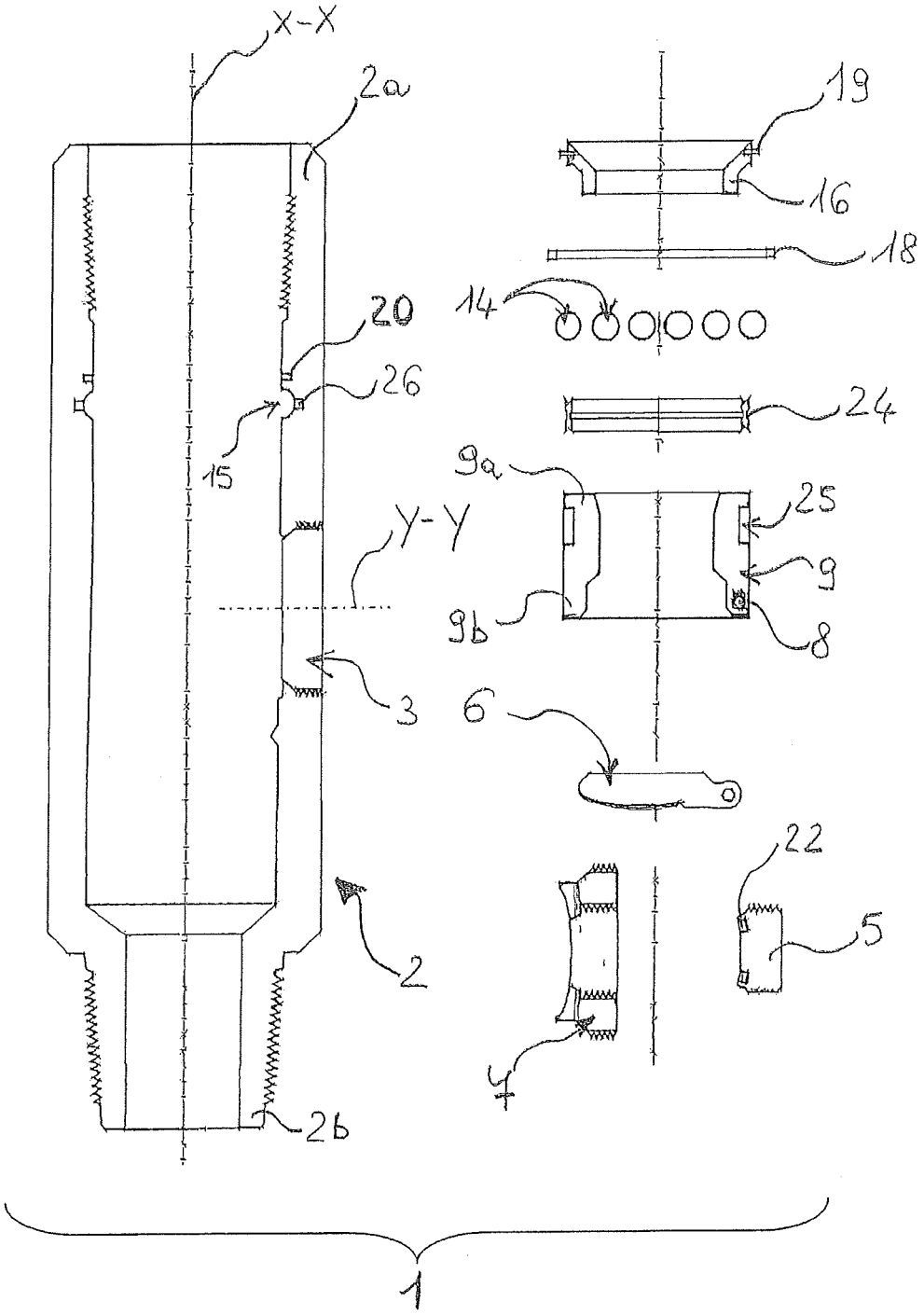
FIG. 3 is an exploded view of the main parts of FIG. 1.
Figure 4A:
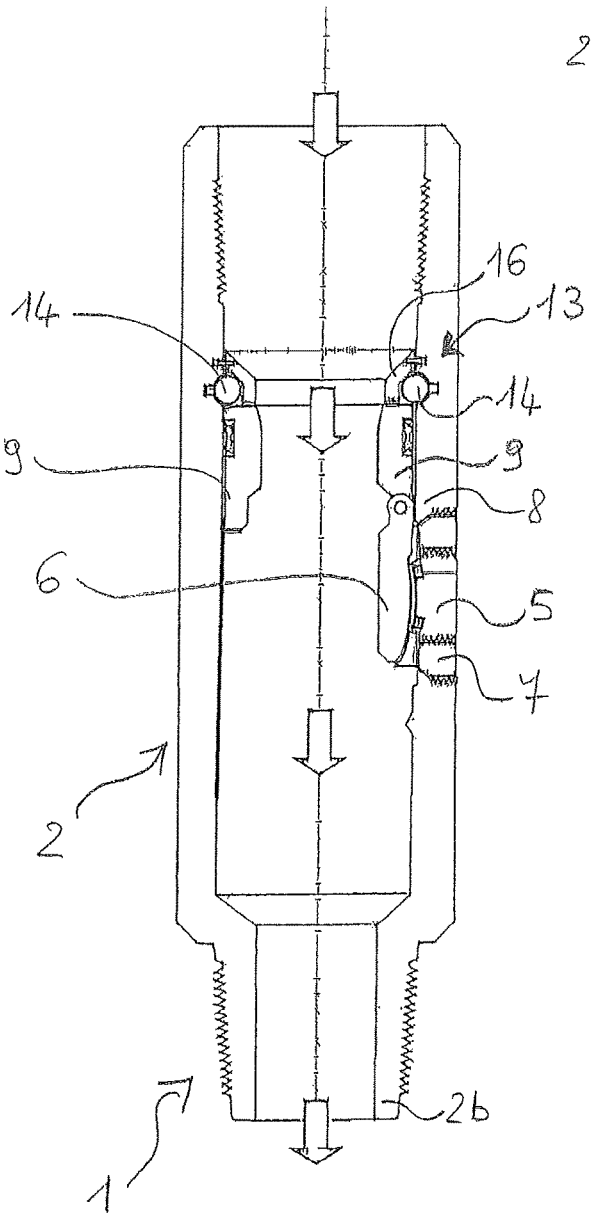
Figure 4B:
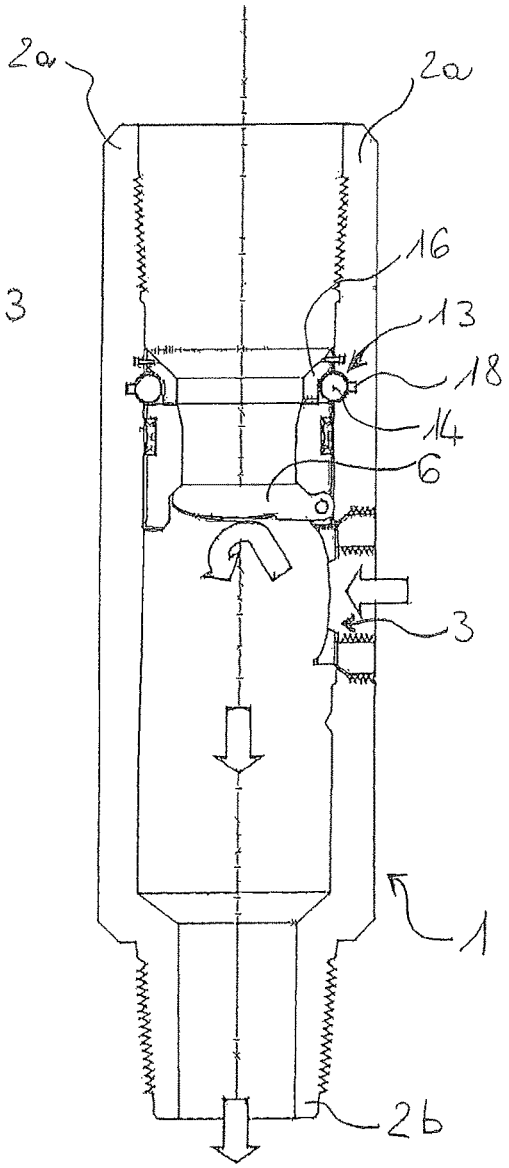
Figures 5, 5A:
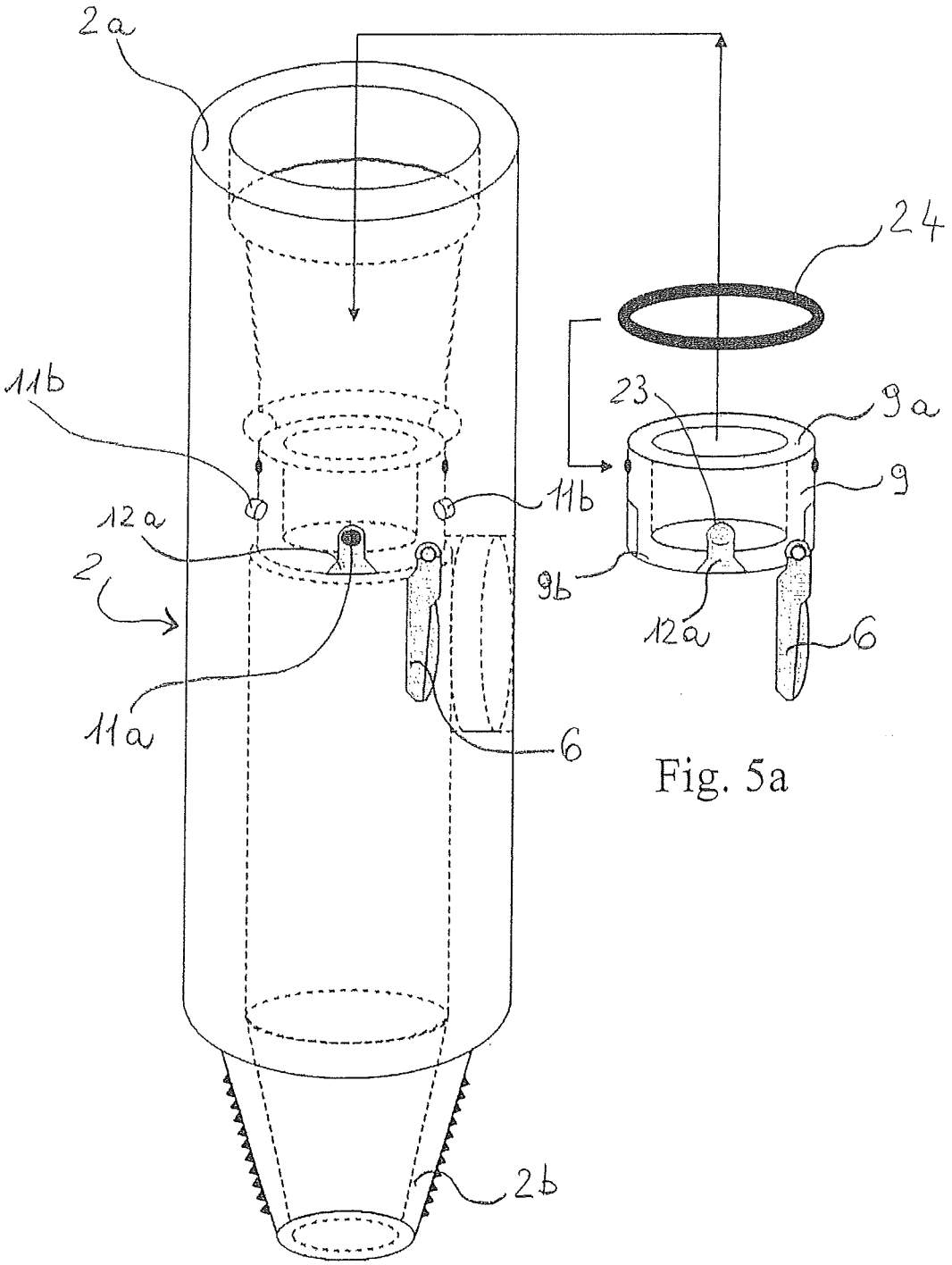
Figure 6:
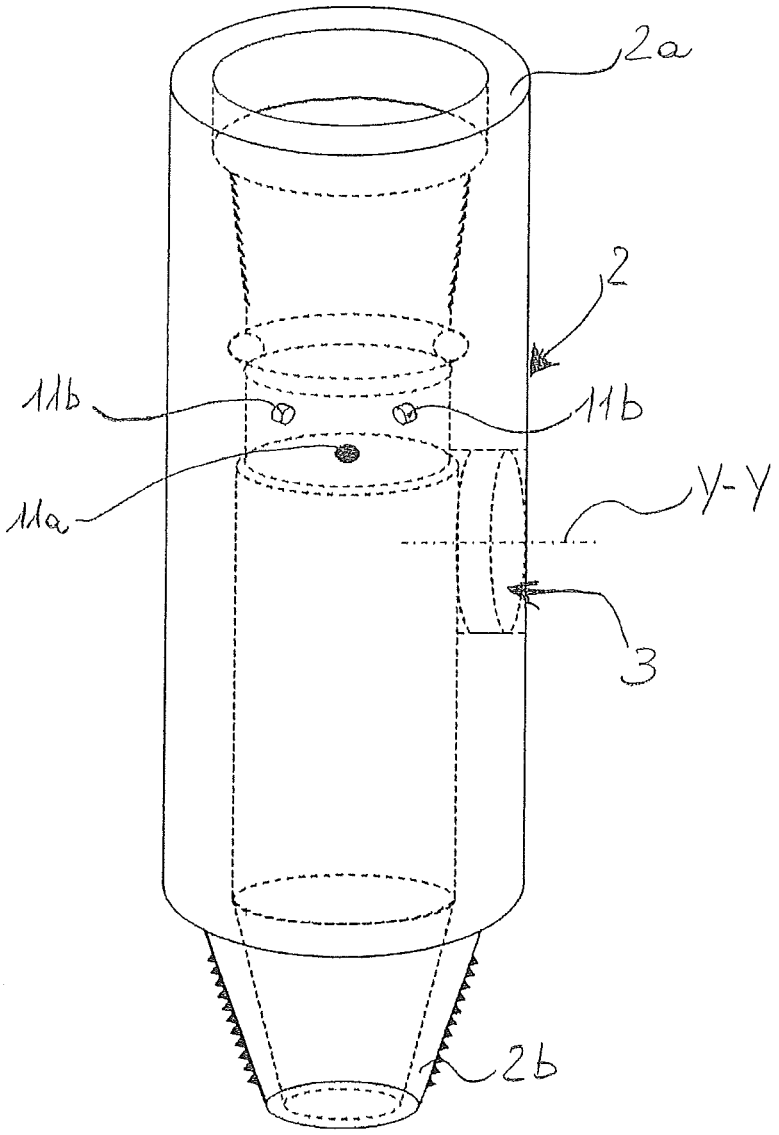
Figure 7:
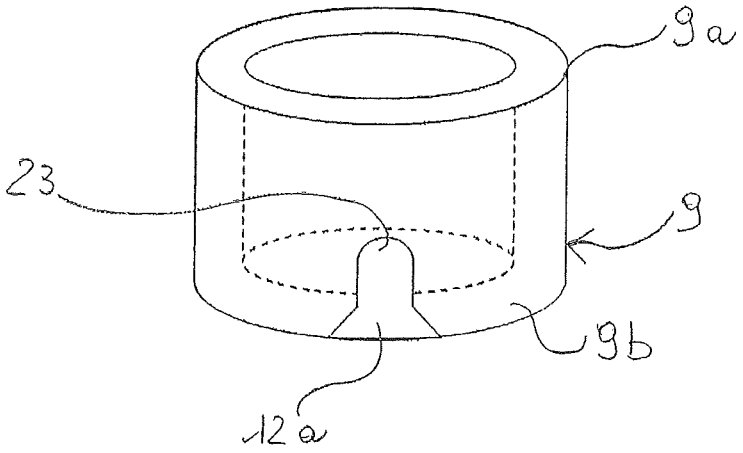
Figure 8:
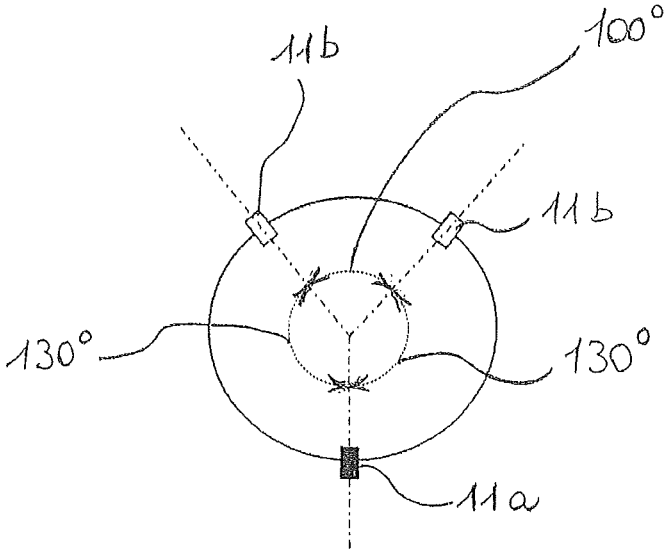
Figure 9:
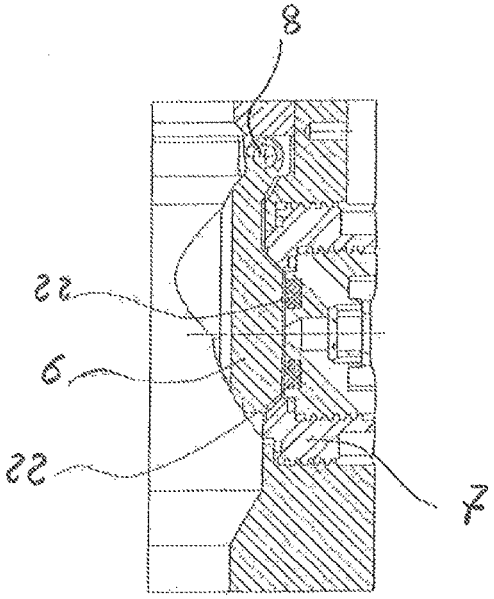
Figure 10:
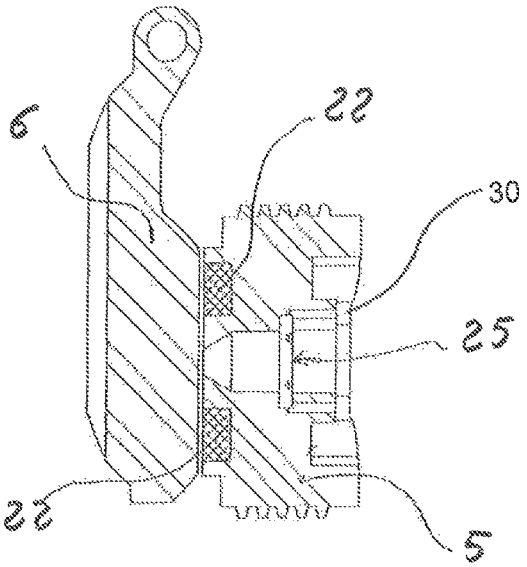
Figure 11:
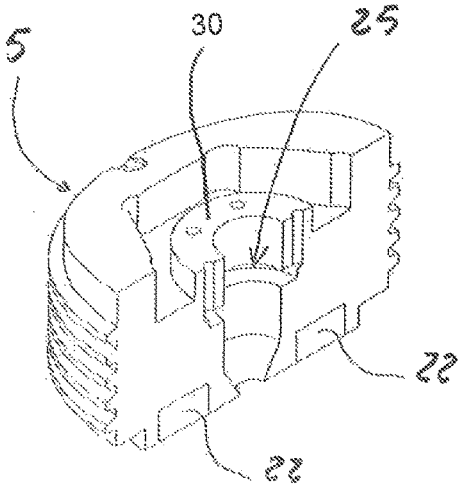
Figure 12:
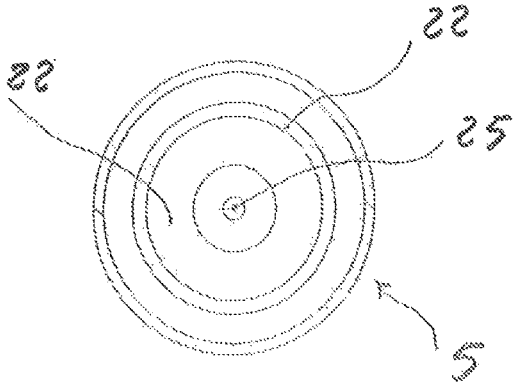

FIGS. 4*a* and 4*b* show the device of the invention in the configurations of FIG. 1 and FIG. 2 respectively, arrows being added to indicate the axis and direction followed by the drilling mud in two different configurations of use, according to the position assumed by the shut-off member;

FIG. 5 shows a simplified diagrammatic perspective view of the device of FIG. 1, in which means for positioning and centering the tubular support for the shut-off member may be seen;

FIG. 5*a* only shows the detail of the tubular support for the shut-off member and its seal;

FIG. 6 only shows the detail of the tubular body of the device of FIG. 5;

FIG. 7 shows a detail of the tubular support for the shut-off member of FIG. 5*a*, FIG. 8 diagrammatically shows the circumferential arrangement of the positioning and centering means in the tubular body of the device of FIG. 5, FIG. 9 shows a cross-sectional view of a detail of the device of FIG. 1 with the shut-off member in longitudinal position;

FIG. 10 is a simplified view of the shut-off and the plug of FIG. 9;

FIG. 11 shows cross-sectional perspective view of the plug of the device of FIG. 1 and FIG. 12 shows a plane front view of the plug of the device of FIG. 1.

Referring to the accompanying figures, numeral 1 generally designates an inventive device for ensuring continuous circulation in well drilling, namely a device for ensuring continuous circulation in well drilling particularly during insertion or removal of a drill string into or out of wells for hydrocarbon exploration and production.

The device 1 comprises:

- a substantially tubular body 2 extending in a preset axial direction X-X from an upstream end 2*a* to a downstream end 2*b*, the tubular body 2 being shown as having a circular cylindrical section;
- an axial conduit extending from the upstream end 2*a* to the downstream end 2*b*, for drilling mud to flow therethrough in the device 1;
- first threaded connection means at the upstream end 2*a* for connection of the upstream end 2*a* of the device 1 to one end of a drill string;
- second threaded connection means at the downstream end 2*b* for connection of the downstream end 2*b* of the device 1 to one end of a drill string;
- a lateral opening 3 located in the tubular body 2 between the upstream end 2*a* and the downstream end 2*b* to define a lateral conduit in the device 1, in fluid communication with the above mentioned axial conduit, the axial conduit having an axis Y-Y which is preferably perpendicular to the axis X-X of the axial conduit;
- a plug 5 removably fitted into the lateral opening 3 in a pressure-tight manner by a threaded nut-screw engagement,
- valve means 6 located in the axial conduit to block the drilling mud and stop its flow from the upstream end 2*a* to the downstream end 2*b;* wherein:

- these valve means comprise a shut-off member 6 that is movably supported in the axial conduit to move from a position transverse to the axial conduit (see FIGS. 2 and 4*b*), in which the shut-off member 6 extends transverse to the axis of the axial conduit to stop fluid continuity between the upstream end 2*a* and the downstream end 2*b* in the axial conduit, and a longitudinal position relative to the axial conduit (see FIGS. 1, 4*a*, 5 and 9), in which the shut-off member 6 substantially extends along the axis of the axial conduit and is located close to a side wall portion within the tubular body 2;
- in such transverse position (see FIGS. 2 and 4*b*) the shut-off member 6 is located between the lateral conduit and the upstream end 2*a* of the tubular body 2 to be placed upstream from the above mentioned lateral opening 3, relative to the flow of the drilling mud in the axial conduit from the upstream end 2*a* to the downstream end 2*b* and
- in such longitudinal position (see FIGS. 1, 4*a* and 5) the shut-off member 6 closes in a pressure-tight manner the lateral opening 3 to stop fluid continuity between the lateral conduit and the axial channel of the tubular body 2.

Concerning drill strings, it shall be noted that, according to an applicable industry standard, these have a male threaded lower end and an opposed nut threaded upper end, which is designed for nut-screw engagement with the lower end of a different drill string. According to this standard, in the device 1 the first screw connection means of the upstream end 2*a* are a nut screw, and the second screw connection means of the downstream end 2*b* are male screw threads.

At the lateral opening 3, the tubular body 2 of the device 1 has a seat for the shut-off member which is designed for pressure-tight engagement by the shut-off member 6, when such shut-off member is in the above mentioned longitudinal position (see FIGS. 1, 4*a* and 5), such seat for the shut-off member allowing the lateral opening 3 and the lateral channel defined thereby to be closed in a pressure-tight manner, as mentioned above.

Preferably, such seat for the shut-off member is an inserted seat 7, and is associated in integral and pressure-tight fashion with the tubular body 2. In accordance with the illustrated embodiment, the inserted seat 7 for the shut-off member is defined by a threaded ring nut, having:

- an outer portion with male screw threads, for pressure-tight nut-screw engagement with corresponding nut threads provided at the lateral opening 3, and
- an inner portion with nut threads, for pressure-tight screw engagement with the male screw threads of the plug 5.

Alternatively, the above-mentioned inserted seat for the shut-off member may be formed as a one-piece with the tubular body 2, and an inserted seat for the shut-off member welded to the tubular body or secured thereto in a manner other than the above described screw connection, may be also used.

Similarly, it shall be noted that the screw engagement between the plug 55 and the inserted seat 7 for the shut-off member is a preferred embodiment, although different removable pressure-tight connection arrangements may be provided.

In any case, both the inserted seat 7 and the plug 5 should have small dimensions, and be at the most flush with the footprint of the outer wall of the tubular body 2, to prevent any radially projecting portion of the tubular body 2 of the device from creating interferences in the well being drilled.

Preferably, the shut-off member 6 comprises a convex, preferably a partially spherical portion/wall, whose convexity faces the lateral opening 3. This spherical portion/wall engages such inserted seat 7 for the shut-off member in a pressure-tight manner, when the shut-off member 6 is in the above mentioned longitudinal position (see FIGS. 1, 4*a* and 5).

Preferably, the above-mentioned valve means consist of a flapper valve having a diaphragm shut-off member 6, which is connected by hinge connection means, at a peripheral portion thereof, to an axis of rotation 8, said diaphragm 6 moving from such longitudinal position (see FIGS. 1, 4*a* and 5) to such transverse position (see FIGS. 2 and 4*b*), and vice versa, by rotating about such axis of rotation 8. Such axis of rotation 8:

extends transverse, preferably perpendicular, to the longitudinal axis X-X of said axial conduit;

is placed close to the inner wall of said tubular body 2;

is circumferentially placed to be substantially located at said lateral opening 3 and is located substantially proximate to said lateral opening 3 in the portion of the tubular body 2 located between said lateral opening 3 and the upstream end 2*a* of the tubular body 2.

As a result, when the tubular body 2 is placed with the longitudinal axis substantially in a vertical orientation, with the upstream end 2*a* located at a higher level than the downstream end 2*b:* the above mentioned hinge connection means and the axis of rotation 8 are placed above the through opening 3 and due to its weight force the diaphragm tends to move to the above mentioned longitudinal position (see FIGS. 1, 4*a* and 5), in which it seals the lateral opening 3.

According to the preferred embodiment of the figures, the shut-off member 6 and the hinge connection means are supported by a tubular support 9 for the shut-off member, which is diagrammatically shown in FIG. 5*a*, and is concentrically fitted in a pressure-tight manner into the tubular conduit defined in the tubular body 2 from the upstream end 2*a* to an axial end-of stroke position as defined by positioning and centering means 11, 12.

As shown in the figures, seal means 24 are provided between the tubular support 9 and the inner tubular wall of the tubular body, to afford pressure tightness. For this purpose, an annular seat is provided in the exterior of the tubular support 9, in which the seal means 24 are housed in outwardly projecting arrangement for interference with the inner tubular wall of the tubular body 2.

Preferably, these positioning and centering means 11, 12 define a polarized insertion key, which is adapted to allow insertion of the tubular support into the tubular conduit defined in the tubular body 2 to said limit stop axial position only when the tubular support 9 is properly angularly rotated relative to the axis X-X of the axial conduit X-X such, in the above mentioned longitudinal position (see FIGS. 1, 4*a* and 5) the shut-off member 6 is located over said lateral opening 3 (namely in pressure-tight engagement relationship with the seat 7 for the shut-off member) for pressure-tight closure thereof.

According to the illustrated embodiment, the above mentioned positioning and centering means comprise a plurality of supporting pawls 11, which radially project out of the inner tubular wall of the tubular body 2 into the axial conduit, as well as a corresponding plurality of recesses 12 provided in the outer wall of the tubular support 9.

More in detail, the tubular body 2 comprises three distinct supporting pawls 11, preferably located on the same diametral plane, which are in such position that a first pawl 11*a* is circumferentially spaced from the two remaining pawls 11*b* by a first angle, other than a second angle that circumferentially separates the two remaining pawls 11*b*. In the example of FIG. 8, the first angle is 130° and the second angle is 100°.

Likewise, the tubular support 9 comprises three recesses 12, i.e. a first recess designed for engagement by the first pawl 11*a* and two remaining recesses designed for engagement by the remaining pawls 11*b*.

It shall be noted that the above mentioned recesses 12 consist of grooves formed in the outer tubular wall of the tubular support 9 from the head end 9*b* of such support facing the downstream end 2*b* of the tubular body 2.

With the above described circumferential arrangement of the supporting pawls 11 and the recesses 12, it will be appreciated that the introduction of the tubular support 9 into the conduit of the tubular body 2 from the upstream end 2*a* thereof until the head ends 23 of the recesses 12 abut their respective pawls is only allowed at a single particular circumferential position of the tubular support 9 about the axis X-X of the tubular body 2.

This arrangement is the above mentioned polarized insertion key, which is adapted to ensure that, in such longitudinal position (see FIGS. 1, 4*a* and 5), the shut-off member 6 will be located exactly at the lateral opening 3, thereby providing the above mentioned pressure-tight engagement with the seat 7 for the shut-off member.

Preferably, the two remaining recesses have such a circumferential width as to allow insertion of their respective supporting pawls 11*b* with a circumferential clearance, whereas the circumferential width of the recess 12*a* allows its respective supporting pawl 11*a* to fit therein with a reduced clearance. Preferably, the above mentioned recess 12*a* is shaped with a lead-in flare (see FIG. 7) at the head end 9*b* of the tubular support 9, for facilitated insertion of the supporting pawl 11*a* into the recess 12*a*.

As an alternative to the above, the positioning and centering means may have different shapes and/or the polarized insertion key between the tubular body 2 and the tubular support 9 may be obtained in a structurally or functionally different manner, the above arrangement having the advantage of being simple, reliable, easily connectable and inexpensive.

The device 1 further comprises retainer means 13 for maintaining the tubular support 9 inserted in the axial conduit, in the above mentioned limit stop axial position.

The retainer means 13 comprise:

a plurality of retainer elements 14, placed in said tubular conduit in a circumferentially offset position and close to the head end 9*a* of the tubular support 9 facing the upstream end 2*a* of the tubular body 2, said retainer elements 14 acting as retainer means to prevent the tubular support 9 from axially moving toward the upstream end 2*a* of the tubular body 2;

an inner seat 15 provided in the inner tubular wall of said tubular body 2 in which a first portion of said retainer elements 14 is accommodated and a locking guide 16 for maintaining said first portion of the retainer elements within the inner seat 15.

According to a preferred and advantageous embodiment, the above mentioned retainer elements 14 (e.g. a plurality of rollers located with their respective axes parallel to the longitudinal axis X-X of the tubular body 2) comprise a great number of retainer elements 14, approximately more than ten, preferably at least fifteen, for covering substantially the entire circumferential extent of the inner annular seat 15.

In practice, the above mentioned retainer elements 14 are circumferentially offset along the inner annular seat 15 in substantially juxtaposed relationship, to define as a whole an annular retainer element whose inside diameter is smaller than the inside diameter of the lateral opening 3.

According to a preferred and advantageous different embodiment, said retainer elements 14 have a spherical shape or comprise spherical surface portions. In this embodiment said above inner annular seat 15 may comprises an hemispherical shape complementary to the shape of the first portion of said retainer elements 14.

Preferably, the above mentioned first portion of the spherical retainer elements 14 inserted in the inner seat 15 is about 40-55% of the volume of the retainer elements 14.

More preferably, the above mentioned first portion of the retainer elements 14 is substantially the half part of each retainer elements 14.

Preferably, the above mentioned inner seat 15 is an annular seat.

Preferably, a circumferential groove 26 is provided in the inner annular seat 15, for receiving magnets, preferably in the form of annular sectors or an open ring 18, whereby the retainer elements 14 can be held in position in the inner annular seat 15 during assembly of the device 1, namely prior to positioning of the locking guide 16.

Instead of or in addition to the provision of the above mentioned magnets in the inner annular seat 15, the retainer elements 14 may be provided in the form of magnetic elements. This may be achieved by magnetizing the retainer elements 14 or associating magnets therewith.

Concerning the above mentioned locking guide 16 for locking the retainer elements 14, it will be appreciated that it may conveniently be held in position within the tubular conduit 2, against the inner wall of the tubular conduit 2, using a Seeger ring 19, which engages in part an inner circumferential groove 20 provided in the inner tubular wall of the tubular body 2 and in part a circumferential groove 21 provided in the outer wall of the locking guide 16.

Advantageously, the device 1 comprises magnetic means for acting upon the shut-off member 6 when it is in the longitudinal position (see FIGS. 1, 4*a* and 5) or in a position close thereto, and holding it in the longitudinal position (see FIGS. 1, 4*a* and 5) with a preset load, with the shut-off member 6 being only allowed to move toward said transverse position when such load is exceeded (see FIGS. 2 and 4*b*).

According to an embodiment that is not shown in the figures, the above mentioned magnetic means may comprise one or more magnets carried by the shut-off member at the side of the shut-off member 6 facing the lateral opening 3 when the shut-off member 6 is in the above mentioned longitudinal position, whereby such magnets may interact with the inner wall of the tubular body 2, with the seat 7 for the shut-off member and/or preferably with a portion of the plug 5.

Preferably, the magnets carried by the shut-off member have a ring shape and are applied to the side of the shut-off member 6 that faces the lateral opening 3 when the shut-off member 6 is in the longitudinal position. This is particularly advantageous when the shut-off member 6 has a substantially circular shape, because the magnetic ring may be applied to the shut-off member 6 in concentric arrangement.

According to the illustrated embodiment, these magnetic means are magnetic means 22 carried by the plug 5, preferably at the inner side of the plug 5, i.e. the one that faces the above mentioned axial channel.

Preferably, the magnetic means 22 have a ring shape, as shown in FIG. 12, although magnets having the shape of annular sectors, disks or others may be used and placed on/in the plug 5.

Possibly, the above mentioned magnetic means may be arranged to be carried both by the plug 5 and by the shut-off member 6, in which case the magnets of the plug and the shut-off member should be arranged in substantially facing positions, for mutual magnetic attraction when the shut-off member 6 is in the above mentioned longitudinal position (see FIGS. 1, 4*a* and 5).

Preferably, there is no direct contact between the plug 5 and the shut-off member 6, a minimum distance being always provided therebetween, to avoid that residual mud prevents the shut-off member to reach the above identified longitudinal position (see FIGS. 1, 4*a* and 5 for the first embodiment and FIGS. 11 and 14*a* for the second embodiment) in which it seals the lateral opening.

As a result, when the shut-off member 6 is in the above mentioned longitudinal position (see FIGS. 1, 4*a*, 5, 9 and 10), a closed chamber is defined between the shut-off member 6 and the plug 5. In order to provide depressurization of such chamber.

According to a preferred embodiment the plug 5 comprises an axial through opening 25 (see FIGS. 9 to 12) at which a mud discharge valve 30 is located, which is adapted to be actuated in a pressure-tight closed state and an open state, for respectively obstructing and allowing the passage of fluid through the through opening, in the latter case allowing the passage of the drilling mud.

Therefore, by opening the above mentioned discharge valve 30, any drilling mud retained thereby may be evacuated, which will improve the stability of the shut-off member in the longitudinal position (see FIGS. 1, 4*a*, 5, 9 and 10), and will ensure pressure-tight closure of the lateral passage.

Preferably, the above identified magnetic means 22 are applied to the plug 5 in such a way to be disposed around said through opening where the discharge valve 30 is housed (see FIGS. 11 and 12).

As clearly shown in the above description, the device 1 of the present invention fulfills the above mentioned need and also obviates prior art drawbacks as set out in the introduction of this disclosure. Due to the provision of the magnetic means the shut-off member may be locked and stabilized with a preset load in its longitudinal position, while preventing undesired hammering of the shut-off member, and without requiring the presence of springs or other biasing means.

Advantageously, due to the possibility of applying the magnetic means to the plug, magnet efficiency may be checked from time to time before mounting the plug, the whole plug being possibly replaced with a fully efficient one, when needed, while the plug with the imperfectly efficient magnets may be serviced for magnet replacement.

It shall be noted that the use of commonly available "super-strong magnets" allows the device of the invention to be also employed at operating temperatures of the order of 80-90° C., which are only rarely found in drilling.

Furthermore, it shall be noted that the use of a plurality retainer elements obviates the problems that occur upon sticking and cementation thereof in the inner annular seat of the tubular body when the tubular support must be removed for maintenance.

Those skilled in the art will obviously appreciate that a number of changes and variants may be made to the above device, still within the scope of the invention, as defined in the following claims.

The invention claimed is:

1. A device for ensuring continuous circulation in Nell drilling, during insertion or removal of a drill string in wells for hydrocarbon exploration and production, the device comprising:

a substantially tubular body extending in a preset axial direction from an upstream end to a downstream end;

an axial conduit extending in said tubular body from said upstream end and said downstream end, which allows drilling mud to flow through the device;

first threaded connection means at said upstream end for connection of said upstream end of the device to one end of a drill string;

second threaded connection means at said downstream end for connection of said downstream end of the device to one end of a drill string;

a lateral opening provided in said tubular body between said upstream end and said downstream end, to define a lateral conduit in said device, in fluid communication with said axial conduit;

a plug removably fitted into said lateral opening, in a pressure-tight manner, by a threaded nut-screw engagement, valve means located in this axial conduit to block said drilling mud and stop flow thereof from said upstream end to said downstream end;

wherein:

said valve means comprise a shut-off member that is movably supported in said axial conduit to move from a position transverse to said axial conduit, in which said shut-off member extends transverse to the axis of said axial conduit to stop fluid continuity between said upstream end and said downstream end in said axial conduit, and a longitudinal position relative to said axial conduit, in which said shut-off member substantially extends along the axis of said axial conduit close to a side wall portion within said tubular body;

in said transverse position, said shut-off member is located between said lateral conduit and said upstream end of the tubular body to be placed upstream from said lateral opening, relative to the flow of the drilling mud in said axial conduit from said upstream end to said downstream end;

in said longitudinal position, said shut-off member closes in a pressure-tight manner said lateral opening to stop fluid continuity between said lateral conduit and said axial channel;

said device comprises magnetic means to operate on said shut-off member in said longitudinal position and retain said shut-off member in said longitudinal position with a preset load, and as the latter is exceeded, said shut-off member may be moved to said transverse position; and said plug has a through opening at which a mud discharge valve is located, which is adapted to be actuated between a closed state and an open state, for obstructing said through opening or cleaning said through opening, to allow the passage of the drilling mud.

2. The device as claimed in claim 1, wherein said magnetic means are carried by said plug for magnetically attractive interaction with said shut-off member when said shut-off member is in said longitudinal position.

3. The device as claimed in claim 2, wherein said magnetic means are placed at the side of said plug that faces said axial channel.

4. The device as claimed in claim 2, wherein said magnetic means, carried by said plug, define a ring.

5. The device as claimed in claim 1, wherein said magnetic means include one or more magnets carried by said shut-off member at the side of said shut-off member that faces said lateral opening when said shut-off member is in said longitudinal position.

6. The device as claimed in claim 5, wherein said one or more magnets carried by said shut-off member comprise a magnetic ring applied to the side of said shut-off member that faces said lateral opening when said shut-off member is in said longitudinal position, said shut-off member has a substantially circular shape and said magnetic ring is applied to said shut-off member concentrically with the circle defined by said shut-off member.

7. The device as claimed in claim 3, wherein, when said shut-off member is in said longitudinal position, said magnetic means carried by said shut-off member and said magnetic means carried by said plug are in substantially facing and spaced relationship, and said facing magnets magnetically attracting each other.

8. The device as claimed in claim 1, wherein said shut-off member comprises a convex portion, whose convexity faces the lateral opening, said convex portion engaging in a pressure-tight manner a seat of the shut-o member, which is provided in said tubular body around said lateral opening.

9. The device as claimed in claim 1, comprising an inserted seat for the shut-off member, which is integrally associated, in a pressure-tight manner, with said tubular body around said lateral opening, wherein said inserted seat for the shut-off member defines a threaded ring nut, having:

an inner threaded portion that provides said threaded engagement with said removable plug, and an outer threaded portion that s engaged in a pressure-tight manner with said tubular body.

10. The device as claimed in claim 1, wherein said shut-off member comprises a diaphragm connected via hinge connection means at a peripheral portion thereof to an axis of rotation, said diaphragm moving from said longitudinal position to said transverse position, and vice versa, by rotating about said axis of rotation, wherein said axis of rotation:

extends transverse to the longitudinal axis of said axial conduit;

is placed close to the inner wall of said tubular body is circumferentially placed to be substantially located at said lateral opening, and is located substantially proximate to said lateral opening in the portion of said tubular body located between said lateral opening and said upstream end of said tubular body, such that, when said tubular body is placed with the longitudinal axis substantially in a vertical orientation, with the upstream end located at a higher level than the downstream end, said hinge connection means and said axis of rotation are placed above said through opening and, due to the weight force, said diaphragm tends to move toward said longitudinal position.

11. The device as claimed in claim 10, wherein said hinge connection means are supported by a tubular support carrying the shut-off member which is concentrically inserted in a pressure-tight manner in said tubular conduit body, from said upstream end to an axial limit-stop position defined by positioning and centering means.

12. The device as claimed in claim 11, wherein said positioning and centering means define a polarized insertion key, which is adapted to allow insertion of said tubular support into said tubular conduit body to said limit stop axial position only when said tubular support is angularly rotated relative to the axis of said axial conduit such that said shut-off member, in said longitudinal position, is located over said lateral opening to ensure pressure-tight closure thereof.

13. The device as claimed in claim 1, wherein said plug comprises an axial through opening at which a discharge valve is located, said discharge valve being adapted to be actuated in a pressure-tight closed state and an open state, for respectively obstructing and allowing the passage of fluid through the through opening, and in the latter case allowing the passage of the drilling mud.

14. The device as claimed in claim 13, wherein said magnetic means are applied to the plug in such a way to be disposed around said through opening where the discharge valve is housed.

15. A device for ensuring continuous circulation in well drilling, during insertion or removal of a drill string in wells for hydrocarbon exploration and production, the device comprising:

a substantially tubular body extending in a preset axial direction from an upstream end to a downstream end;

an axial conduit extending in said tubular body from said upstream end and said downstream end, which allows drilling mud to flow through the device;

first threaded connection means at said upstream end for connection of said upstream end of the device to one end of a drill string;

second threaded connection means at said downstream end for connection of said downstream end of the device to one end of a drill string;

a lateral opening provided in said tubular body between said upstream end and said downstream end, to define a lateral conduit in said device, in fluid communication with said axial conduit;

a plug removably fitted into said lateral opening, in a pressure-tight manner, by a threaded nut-screw engagement, valve means located in this axial conduit to block said drilling mud and stop flow thereof from said upstream end to said downstream end;

wherein:

said valve means comprise a shut-off member that is movably supported in said axial conduit to move from a position transverse to said axial conduit, in which said shut-off member extends transverse to the axis of said axial conduit to stop fluid continuity between said upstream end and said downstream end in said axial conduit and a longitudinal position relative to said axial conduit, in which said shut-off member substantially extends along the axis of said axial conduit close to a side wall portion within said tubular body;

in said transverse position, said shut-off member is located between said lateral conduit and said upstream end of the tubular body to be placed upstream from said lateral opening, relative to the flow of the drilling mud in said axial conduit from said upstream end to said downstream end;

in said longitudinal position, said shut-off member closes in a pressure-tight manner said lateral opening to stop fluid continuity between said lateral conduit and said axial channel;

said device comprises magnetic means to operate on said shut-off member in said longitudinal position and retain said shut-off member in said longitudinal position with a preset load, and as the latter is exceeded, said shut-off member may be moved to said transverse position said shut-off member comprises a diaphragm connected via hinge connection means at a peripheral portion thereof to an axis of rotation, said diaphragm moving from said longitudinal position to said transverse position, and vice versa, by rotating about said axis of rotation, wherein said axis of rotation:

extends transverse to the longitudinal axis of said axial conduit;

is placed close to the inner wall of said tubular body;

is circumferentially placed to be substantially located at said lateral opening, and is located substantial proximate to said lateral opening in the portion of said tubular body located between said lateral opening and said upstream end of said tubular body, such that, when said tubular body is placed with the longitudinal axis substantially in a vertical orientation, with the upstream end located at a higher level than the downstream end, said hinge connection means and said axis of rotation are placed above said through opening and, due to the weight force, said diaphragm tends to move toward said longitudinal position, said hinge connection means are supported by a tubular support carrying the shut-off member which is concentrically inserted in a pressure-tight manner in a tubular body, from said upstream end to an axial limit-stop position defined by positioning and centering means;

retainer means to maintain said tubular support inserted in said axial conduit in said limit stop axial position, wherein said retainer means comprise:

a plurality of retainer elements, placed in said tubular body in a circumferentially offset position and close to an end of said tubular support facing said upstream end of the tubular body, said retainer elements acting as retainer means to prevent said tubular support from axially moving toward said upstream end of the tubular body;

an inner seat provided in the inner tubular wall of said tubular body in which a first portion of said retainer elements is accommodated, and a locking guide engaged with said inner tubular wall of said tubular body to maintain said portion of said retainer elements within said inner seat.

16. The device as claimed in claim 15, wherein said inner seat is an annular seat having a profile matching the profile of said portion of said retainer elements housed therein.

17. The device as claimed in claim 16, wherein magnets are accommodated in said annular seat to hold said retainer elements in position in said seat.

18. The device as claimed in claim 15, wherein said retainer elements are magnetic or include magnetic means.

19. The device as claimed in claim 15, wherein said locking guide is held in position against said inner wall of said tubular body by a Seeger ring.

* * * * *